United States Patent [19]

Keim

[11] Patent Number: 4,590,625

[45] Date of Patent: May 27, 1986

[54] GOLFER'S GLOVE

[76] Inventor: George F. Keim, 9671 E. Rand Pl., Tucson, Ariz. 85715

[21] Appl. No.: 713,188

[22] Filed: Mar. 18, 1985

[51] Int. Cl.[4] ..... A41D 19/00

[52] U.S. Cl. ..... 2/161 A; 2/163

[58] Field of Search ..... 2/159, 161 A, 160, 163

[56] References Cited

U.S. PATENT DOCUMENTS

| | | | |
|---|---|---|---|
| 1,483,595 | 2/1924 | Read . | |
| 1,887,278 | 11/1932 | Auster | 2/161 A |
| 2,242,318 | 5/1941 | Mosier | 2/159 |
| 2,379,430 | 7/1945 | Frost | 2/159 |
| 2,465,136 | 3/1949 | Troccoli | 2/159 |
| 2,554,991 | 5/1951 | Kramer | 2/159 |
| 3,096,523 | 7/1963 | Bruchas | 2/159 |
| 3,100,302 | 8/1963 | Billings | 2/160 |
| 3,255,461 | 6/1966 | Bullock | 2/159 |
| 3,508,280 | 4/1970 | Osborn | 2/159 |
| 3,597,765 | 8/1971 | Stanton | 2/159 |
| 3,922,724 | 12/1975 | Shockovsky | 2/161 A |

FOREIGN PATENT DOCUMENTS

| | | | |
|---|---|---|---|
| 0306028 | 2/1933 | Italy | 2/159 |

*Primary Examiner*—Louis K. Rimrodt

*Attorney, Agent, or Firm*—J. Michael McClanahan

[57] ABSTRACT

An improvement for attachment to a golfer's glove consisting of soft flexible pads situated between the first and the second joints on the first three fingers and the palm of the accuracy hand glove, i.e., left hand glove for a right-handed golfer, the pads having different thicknesses in accordance with the concavity of the golfer's palm and distance the fingers are from the surface of the club shaft held in the hand, the pads adapted to increase the pressure of the first three fingers between the first and second joints and the palm upon the club, and thus enhance the "feel" of the golf club shaft in the hand of the golfer for an improved golf game.

15 Claims, 11 Drawing Figures

GOLFER'S GLOVE

BACKGROUND OF THE INVENTION

Feel, in golf language is virtually impossible to define. It is common knowledge that for a right-handed golfer, the right hand that grips the golf club shaft is the power hand and the left hand, which is situated above the right hand on the golf club shaft, is the accuracy hand. There seems to be no end to what definitions determine the feel of the golf club shaft in the golfer's hands. For example, in the March 1978 issue of Golf Magazine, the editors interviewed a dozen professional golfers as to what "feel" was to them. The report, which was reported on Page 118, gave many explanations as to what "feel" was. For example, the relationship between the hands and the brain, wherein the brain takes into account many factors, from the environment to a particular golfer's mental and phvsical state at the particular time the golf club is grasped.

Four of the golfers stated what the Inventor believes to be correct, namely that "feel" is defined as the golfer's sense of the golf club shaft in his or her hands and how the brain perceives the golf club in the golfer's hands. The sensory feed-back of pressure information from the hands to the brain allows the brain to make the decisions which then inform the golfer's muscles how to move or adjust the hands upon the golf club, until the brain determines that a correct "feel" is obtained. Pressure feed-back works on the deeper, unconscious level of awareness, as opposed to such sensory feed-back as pain and temperature.

In achieving this correct "feel", and in particular, the "feel" of the left hand on the club (for a right-handed golfer), the brain is relying on the specialized nerve sensors buried in the four fingers and the palm of the left hand. These pressure-sensitive nerve receptors are called "Pacinian bodies". The Pacinian bodies are connected to the brain by the ulnar and median nerves, which travel up the arm to the brain.

As the left hand grasps the golf club shaft, unequal pressure is felt by the Pacinian bodies in each of the four fingers and the palm of the hand because of the natural concave shape of the palm of the hand and the location of the fingers which connect to the palm. The palm of the hand, in its natural position, is slightly concave, generally referred to as having a concavity. The concavity deepens as tne hand flexes as in grasping the golf club handle. Additionally, the palm of the hand is slightly elevated at the point the fingers connect. Accordingly, then, it is obvious that the fingers at opposite ends of the concavity will feel the greatest pressure on the straight club shaft lying across the palm, namely the index and the little finger, while the Pacinian bodies located on the two middle fingers, as well as the palm area, receive less stimulation. In fact, if the left hand were so situated on the golf club as to make substantially equal pressure feelings in each area of the fingers and in the palm, the hand would be deformed from its normal configuration. Clearly, if the accuracy hand is deformed, even though done unconsciously, in trying to grasp the club when making a swing, control of the swing is going to be greatly hampered, and could quite logically be accepted as the cause of golf being such a difficult game.

It is the Inventor's belief that the present trend of golfers today to wear very tight gloves as an attempt, unconscious or otherwise, to enhance "feel" by the very nature of being able to feel the glove on the hand.

Obviously then, it is easy to see that "feel" of the golf club in the golfer's hand is very hard to define and just as hard to obtain.

It is the object of correcting this problem of obtaining a proper"feel", to which the subject invention is directed.

SUMMARY OF THE INVENTION

The embodiment of the invention described consists of flexible, varying thickness pads attached to a golfer's left hand glove (for a right-handed golfer) between the first and second joints of the first three fingers and in the palm to enhance the pressure felt by the hand, i.e., "feel", of the golf club shaft in the hands of the golfer.

To accomplish the invention, pads, determined by the concavity of the golfer's left hand palm (for a right-handed golfer) to match the natural cavity of the palm and the fingers to the straight line of the golf club shaft, are attached to the golfer's glove. In this manner, substantially equal pressure can be made to be felt by each finger between the first and second joint as is felt between the second and third joint, and the third joint end of the fingers, for each finger of the left hand surrounds the golf club shaft. Similarly, placing a pad in the palm also brings up the palm to "feel" the golf club, an area that heretofore had very little "feel" of the shaft. Through such measures, the pressure sensitive receptors in the hand transmit to the brain a signal of comfortability, spatial orientation, and complete "feel" of the golf club shaft in the golfer's hand and therefore permit more complete control of the golf club swing for all the clubs and the putter.

It has been determined that for best results, the chosen fingers to receive the pads, in addition to the palm, are the first three fingers, namely the index, middle, and ring finger.

No other surface area of hand or fingers may be padded, because the remainder of the hand has been determined to be in adequate contact with the club handle. Any added pressure on such surfaces would again upset the ideal balance, and would present the brain with an unnatural and faulty picture of hand pressures on club handle. The resultant swing would, as a natural consequence, be faulty.

In an alternate embodiment, it has been determined that good results may also be obtained by utilizing the first three fingers to receive the pads without the palm pad.

The pads consist of soft, flexible material no easily compressed, such as leather, cloth, and different types of rubber, some foam rubbers, and plastics.

Accordingly, it is an object of the subject invention to provide means to enhance the pressure being felt between the first and second joints, only, of the first three fingers and the palm of the golfer's accuracy hand.

It is another object of the subject invention to provide pads interposed the golf club shaft and the first three fingers between the first and second joints, only, for enhancing the "feel" of the club in the golfer's hand.

It is another object of the subject invention to increase the feel of the golf club shaft in the folger's hand in order to better control the accuracy of the golf stroke.

Other objects of the invention will in part be obvious and will in part appear hereinafter. The invention accordingly comprises the apparatus possessing the construction, combination of elements, and arrangement of parts which are exemplified in the following detailed disclosure and the scope of the Application of which will be indicated in the Claims.

BRIEF DESCRIPTION OF THE DRAWINGS

For further understanding of the features and objects of the subject invention reference should be had to the following detailed description taken in connection with the accompanying drawings wherein.

In the various views, like index numbers refer to like elements.

DETAILED DESCRIPTION OF THE PREFERRED EMBODIMENT

Figure 1:
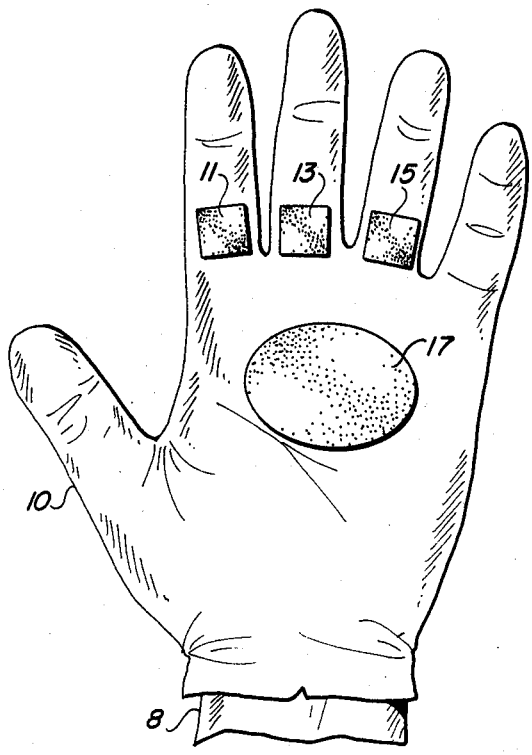
FIG. 1 is a front view of the invention attached to the left-hand glove of a right-handed golfer.

Referring now to FIG. 1, a front view of the subject invention is shown on the golfer's left hand glove 10 (for a right-handed golfer). In particular, pads 11, 13, and 15, are shown situated in position between the first and the second joint of the index, middle, and ring fingers respectively of the left hand glove. Located approximately central in the palm area of glove 10 is palm pad 17. It is noted that conspicuously absent is a pad for the little finger or for the thumb.

In the preferred embodiment, the finger pads are generally square shaped and the palm pad circular or oval, and not necessarily of equal thickness, but in fact will vary in thickness relative to each other in accordance with the concavity of the hand, and the relationship of the fingers to the hand concavity, as described later. The invention is not intended to be limited to pads of the shape above described, but these pads may take any shape as their sole purpose is to be placed between the fingers and palm and the golf club shaft to place pressure upon the fingers and the palm.

The glove 10 shown in FIG. 1 may be, prior to the attachment of the above described pads, an ordinary golfer's type glove.

Figure 2:
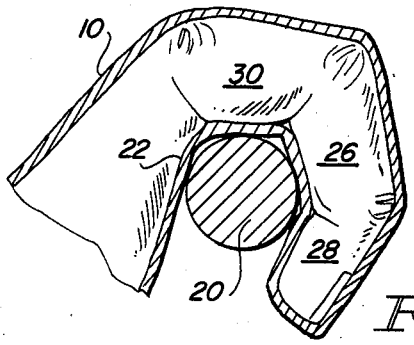
FIG. 2 is a typical view taken along a representative finger and palm of the left hand surrounding a golf club shaft.

Referring now to FIG. 2, a view is shown of the gloved left hand (for a right-handed golfer) without the inventive pads where the view is taken with a representative finger, such as the middle finger, or if desired, the index and ring fingers, and the portion of the palm directly across from the finger, both gripping the golf club shaft. In FIG. 2, shaft 20 is held most strongly by the area of the finger most directly opposite the palm, namely the area 26 between the second and third joints of the finger, and somewhat less stronger by the area 28 between the third joint and the end of the finger. Meanwhile, the area 30 between the first and second joints of the finger is the area which, together with the palm area 22 directly across from the fingers, applies the least amount of pressure and thus feels the least amount of pressure on the golf club shaft.

The reason for this, as respects the palm area 22, is that in the area where the finger joins the palm, the palm surface has dropped below the palm surfaces proximate the index finger and the little finger between which the golf club resides. In FIG. 2, the palm area is shown touching the club shaft, however this is due to the flexibility of the palm and the pressure exerted by the particular area of the palm is not equal to the pressure applied by finger areas 26 and 28. Similarily, respecting area 30 between the first and second joints of the finger, much less pressure is applied to the golf club shaft as fingers areas 26 and 28 do for several reasons, the first being that the base of the finger at the palm is such as to place it at a mechanical disadvantage with respect to the index and little fingers in terms of being farther away from the shaft due to the arcuate shape of the palm at the periphery where the fingers attach, and secondly, the golf club shaft is being held away from the area 30 by opposite ends of the palm. In addition, the finger is at a mechanical disadvantage in being connected to the palm at a point on the concavity.

Consequently, palm area 22 and finger area 30 do not have the pressure "feel" of the golf club shaft as more clearly do the finger areas 26 and 28.

It is noted that the example of the middle finger was used in FIG. 2, yet the same analogies may be applied, though to a lesser extent to the ring finger, and even to a lesser extent than the ring finger, to the index finger.

Figure 3:
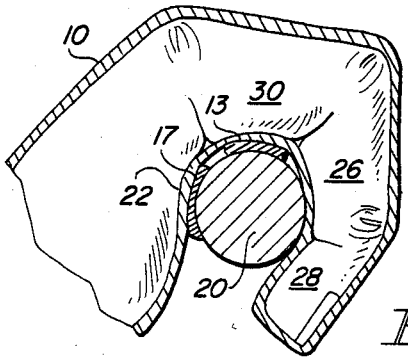
FIG. 3 is a typical view taken along a representative finger and palm of the left hand surrounding a golf club shaft with the invention in place.

Referring now to FIG. 3, a view is shown of the typical palm-finger relationship for the same representative middle finger as shown in FIG. 2, where the inventive pads have been attached to the glove 10 and now are interposed between the left hand (for a right-handed golfer) and the golf club shaft. Now looking at the pressures which are exerted by the fingers and the palm against the shaft 20 while the left hand is grasping the shaft, the heavy pressures in areas 26 and 28 have not changed appreciably, however, the area 30 of the finger directly over pad 13 now feels more pressure upon it and, with proper thickness of pad 13, may feel approximately the same level of pressure as is felt by finger areas 26 and 28. Similarly, the area 22 in the palm of the hand has pad 17 between it and golf club shaft 20 and so it now feels pressure being exerted against it by the golf club shaft as it is grasped in the left hand. In this case, the golf club shaft has not been moved from the position it originally occupied in FIG. 2, and the pressures exerted at areas 26 and 28 have not been changed, however, the slack has been taken up in the areas proximate finger area 30 and palm area 22 such as to enhance and increase the pressure by virtue of the respective pads located there. The increased pressure there felt by the Pacinian bodies at the nerve endings is transmitted to the brain and the brain thus acquires an accurate "feel" of the golf club shaft in the left or accuracy hand, for the right-handed golfer, which was unclear before insertion of the pad.

All descriptions above referring to the invention applied to the left-handed glove for the right-handed golfer apply equally to the right-handed glove for the left-handed golfer, and it is to be understood that the invention is applied to both the left hand glove and the right hand glove for a right-handed and left-handed golfer respectively.

While in FIG. 3 the example of the middle finger and the palm area directly across from the middle finger was utilized, it is to be realized that the same arguments and analogy may be applied, but in a somewhat lessened degree, to the ring finger, and even in a somewhat further lessened degree, to the index finger.

As a consequence now of the increased "feeling" in the area between the first and second finger joints of the first three fingers on the left hand due to the increased pressure exercised by the pads, the golfer has a more complete "feel" of the club in his hand and thus is given more control over the movement of the club by the brain, being able to sense and have a more complete understanding of the location of the club and of the forces which tend to react with the hand providing for the desired swing of the golf club. It has been determined that only the first three fingers of the accuracy hand, the left hand for a right-handed golfer, should receive the inventive pads to enhance and increase pressure between the golf club shaft and the areas of the fingers between the first and second joints. It is important that the little finger not be equipped with a pad for the reason that the little finger does not need such enhanced feeling over that feeling it already experiences. This is so for at least two reasons, firstly, the little finger plays a very small part, if any at all, in directing the swing of the club. Secondly, because the little finger is located at one end of the palm which surrounds the golf club shaft, it is not as adversely affected, if any at all, by the natural concavity of the palm and does not suffer from being naturally farther away from the golf club shaft than the other fingers.

In fact, in a book written by Lou Graham entitled "MASTERING GOLF", Contemporary Books, Inc., Chicago, Ill., the author suggests that before putting, of placing a golf ball between the club handle and the smaller fingers of the left hand, principally the little finger, and then taking a couple of practice swings with the club. Following that, the golf ball is removed from this position and then the golfer makes his swing. The obvious reason for this is to train the hand to take a configuration that very little pressure is placed upon the golf club by the little finger of the left hand, so that the guiding and sensing movements of the golf club is transferred to the area of the left hand forward of the little finger, namely the first three fingers.

Figure 4:
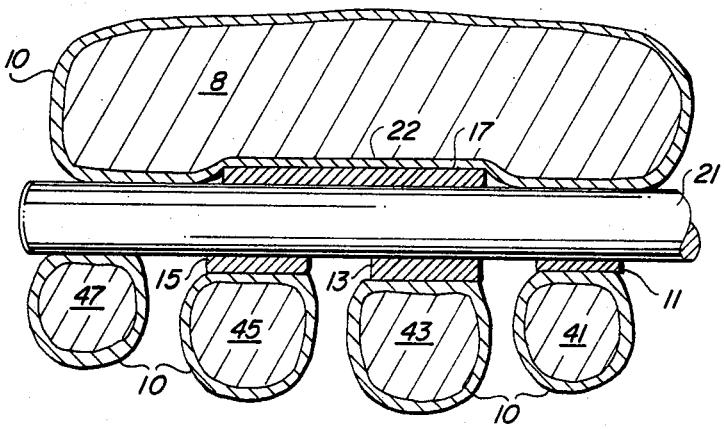
FIG. 4 is a sectional view of the left hand taken transversely across the fingers and palm grasping a golf club shaft with the invention in place.

To determine what are the suggested pad thicknesses for the first three fingers and the palm of a right-handed golfer's left hand, a cross-sectional view of the left hand surrounding a golf club shaft is shown in FIG. 4. Referring now to FIG. 4, golf club shaft 20 is shown in sectional view with the fingers of the left hand also in sectional view between the first and the second joints. The palm of the hand is shown in the Figure with its related palm pad. Starting from the right, the first or index finger 41 is shown, surrounded by glove 10 with pad 11 interposed the golf club shaft 20. Next to the index finger 41 is the middle finger 43, also surrounded by glove 10 having interposed between it and golf club shaft 20, pad 13. Following the index finger, ring finger 45, similarily surrounded by glove 10, is shown in its relationship to golf club shaft 20 having pad 15 therebetween. Lastly, little finger 47 is shown, again covered by glove 10, resting on the end of the golf club shaft without a pad interposed it and golf club shaft 20. Immediately opposite the finger pads is the palm pad 17 residing between the palm 22 of the left hand 8 and the golf club shaft.

It is readily apparent from FIG. 4 that the centrally located finger pads 13 and 15 are thickest of the finger pads, spanning the distance between the club shaft 20 and respective fingers, accounting for the natural concavity of the hand and the greater distance from the palm central area that the base of these fingers connect (the palm of the hand being somewhat rounded at the periphery where the fingers connect). Pad 11 situated on the index finger 41 is the thinnest of the finger pads, little finger 10 having no pad at all. Palm pad 17 thickness will vary in accordance with the person's hand concavity and may well constitute the largest variance from golfer to golfer. Here the pad was shown with a thickness of approximately that of the ring finger pad 15.

It is realized that due to configurations of different golfer's hands, the pad thicknesses shown in FIG. 4 will vary, both in thickness, and in thickness relative to each other. It is also obvious that a perfect fit on an individual would only be possible after extensive measurements of the hand were taken to determine its degree of natural concavity and matching the pads to that; however, utilizing a representative hand, such as shown in FIG. 4, the inventive pads, will in fact, increase the "feel" of the golf club in the golfer's hands and improve the golfer's stroke by better informing the brain of the information necessary for coordinating the muscles making the stroke, and feeling the orientation of where the golf club is. Thus, while the pad thicknesses shown for a representative hand may not be perfect for each golfer, yet the mere fact of utilization of the pads and their placement do benefit all golfers by providing for increased pressure upon areas between the first and second joints of the first three fingers of the left hand for a better "feel" of the golf club. This is even true for pads of equal thickness, the difference only being a matter of degree between its thickness and the "perfect" thickness.

In FIG. 4, the pads shown are attached to the glove 10 and, in most usual configurations, would be sewed to the glove, and as a consequence would tend to bend around the finger of the golfer so that the pads will take a crescent shaped appearance when viewed in cross-section such as in FIG. 4. In FIG. 4, the pads are idealized in order to show the thickness of the pads, the thicknesses in relationship to each other, and the thickness of the pad in relationship to the distance between the areas of the finger between the first and second joints and the golf club shaft.

Figure 5:
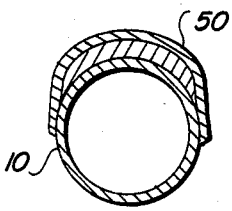
FIG. 5 is a sectional view of the glove with the inventive pads in place.

Referring now to FIG. 5, a cross-sectional view of a representative pad in place on the glove 10 is detailed. It is noted that the pad in this illustration does take the crescent shape and is covered with an outside covering 50 which is attached to the glove material by sewing. Obviously, the covering 50 must be flexible and its thickness taken into consideration when determining the underlying pad thickness. Alternatively, an adhesive around the outside of the covering could be used as an attachment medium. In the FIG. 5 illustration, the covering 50 extends beyond the pad to cover the pad completely so that the sewing or adhesive between the cover 50 and the glove 10 is around the periphery of the pad and does not contact the pad.

Figure 6:
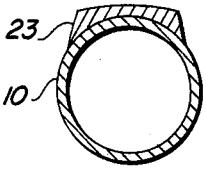
FIG. 6 is a sectional view taken of the glove with the alternate embodiment in place.

An alternate embodiment of the invention is shown in FIG. 6 where the pad material conforms to the roundness of the finger covered by glove 10 by having the ends of the pads extend downward so that the inside of the pad 23 has a concave surface. In the embodiment shown in FIG. 6, no outside covering surrounds pad 23, pad 23 attached to the glove 10 by a flexible adhesive, or even by sewing through the pad and the glove with thread (the glove surface should conform to the interior surface of pad 23). It is noted that even with the pad shown in FIG. 5, where the pad is bent around the shape of the finger, the pad may be attached by a flexible adhesive or also by sewing through the pad and the glove material with preferably a stretching thread.

In all embodiments, it is equally obvious that the pads could be attached by hook and loop type material, one attached to the glove and the other to the pad, such as VELCRO material.

In the embodiments detailed above, the pads are preferably constructed of soft, flexible, relatively noncompressible material, such as leather, rubber, some sponge or foam rubbers, soft plastic, or the like.

While the invention has been concerned with utilizing the devices in connection with the game of golf, it is obvious that the invention may be extended to any other game or other situation where one or more hands hold a round, square, oblong or most any other shape structure in the hand or hands where the purpose is to swing or manuever that structure at a specific time and to a specific place. Accordingly, the invention may be utilized by a baseball batter where, for the right-handed player, the left-hand glove with the invention applied is used; or in other sports, such as in tennis where, since only one hand usually grips the tennis racquet and thus becomes the accuracy hand, the glove of the hand grasping the tennis racquet is modified with the invention.

Not to be left unsaid, in addition to the use of the invention for sports, many occupations require the worker to use their hands grasping a tool which strikes a piece of work—such as a carpenter holding a hammer. Obviously the invention is also applicable to such an application for the reason that in the hand squeezing around the handle with the pads in place, the hand is less deformed, thus less tiring, and more support, like arch supports in shoes easing the tensions of the foot, is given the hand. The similarity is fur thered by, the fact that Pacinian bodies are located in the soles of the feet, as well as in the palms of the hands.

Figure 7:
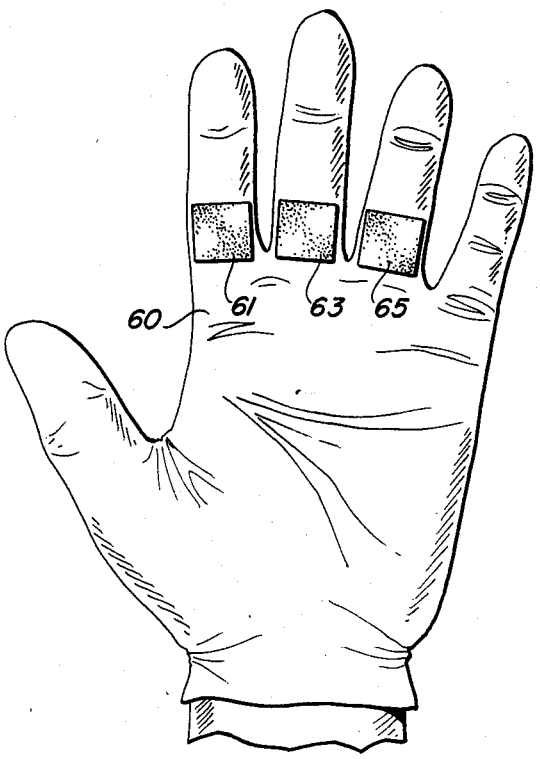
FIG. 7 is an alternate embodiment of the invention emplaced upon the first three fingers of the glove.

In developing the invention, the Inventor discovered that "feel" for the golfer is also improved by utilization of the finger pads on the first three fingers without the application of a palm pad. FIG. 7 shows an alternate embodiment wherein the palm pad is not present, and that the glove 60 only has attached to it the finger pads 61, 63, and 65, situated between the first and second finger joints of the index, middle, and ring fingers respectively.

For golfer's with an exceptionally supple hand wherein the palm of the hand has the malleability to conform to the club shaft, the use of a palm pad may not be needed or desired to achieve a satisfactory "feel". In such case, the alternate embodiment shown in FIG. 7 may be utilized.

Figure 8:
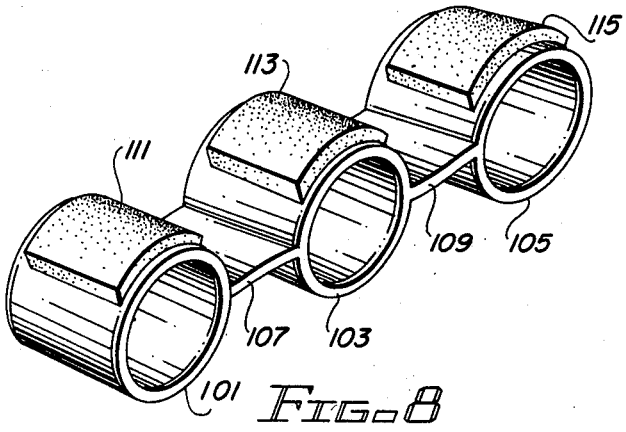
FIG. 8 is a perspective view of another alternate embodiment of the invention detailing finger sleeves.
Figure 9:
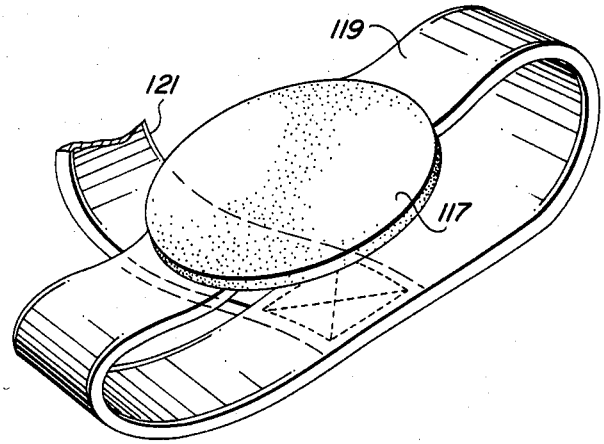
FIG. 9 is a perspective view of another alternate embodiment of the palm pad.

Referring now to FIGS. 8 and 9, another alternate embodiment of the subject invention as shown in FIG. 1 is detailed. Here the glove 10 has been eliminated and the various finger pads have been replaced by finger sleeves 101, 103, and 105 having attached individual pads 111, 113, and 115 respectively. The finger sleeves are then connected to each other by flexible straps 107 and 109 which join the finger sleeves at their sides, or, in the alternative, the strap may be one continuous strap joining all the finger sleeves at a point opposite the pads, i.e., across the tops of the finger sleeves as the sleeves were in place on a golfer's hand. The finger sleeves shown in FIG. 8, together with their attached pads, constitutes the whole pad which is interposed between the finger and the golf club. The sleeves shown in FIG. 8 have added pads, although it is realized that since the glove had been eliminated, the thickness of the sleeve also contributes to constitute the thickness of the pad. Accordingly, it may be possible to eliminate a separate pad on the finger sleeve by making the finger sleeve of sufficient thickness to be the total pad. Here again, thickness of each finger sleeve will vary in accordance with the invention; or if varied thickness pads are added, the combined thickness in accordance with the invention.

The finger sleeves shown in FIG. 8 may be used by themselves as is the alternate embodiment of the invention disclosed in FIG. 7, or may be used in combination with the palm pad 117 shown in FIG. 9. The palm pad shown in FIG. 9 is adapted to be worn in the palm of the golfer"s hand (left hand for a right-handed golfer) and has a flexible elastic strap 119 which encircles the hand at the palm area to hold the pad in place during use. Obviously, the strap would run between the thumb and the index finger on one side of the palm and then around the opposite side of the hand. Shown attached to strap 119 is a transverse situated strap 121 adapted to attach, if desired, to the finger sleeves of FIG. 8. Strap 121, being located on the top of the golfer's hand attaches to the strap connecting the finger sleeves.

It is noted that even the alternate embodiment of FIG. 7 is adaptable to wearing palm pad 117 over the glove, or for that matter, the sleeves of FIG. 8 may be worn over a regular golf glove.

Figure 10:
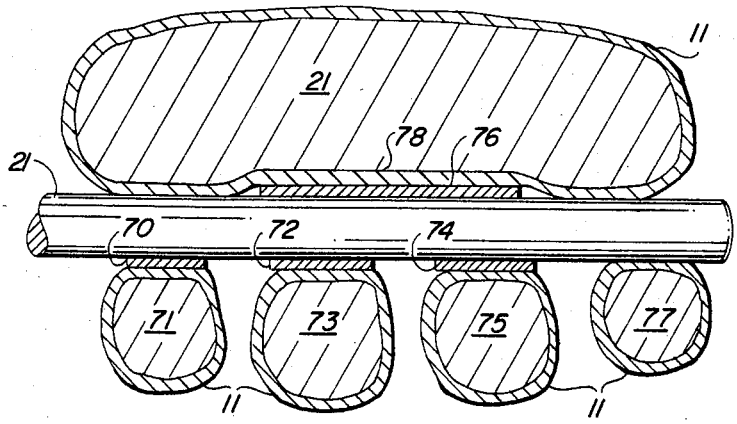
FIG. 10 is a further alternate embodiment of the invention utilizing equal thickness pads in a sectional view of the right hand for a left-handed golfer.

As had been mentioned earlier, a golfer's "feel" of the golf club is still enhanced with pads of equal thickness over the situation of no pads at all. In FIG. 10, a cross-sectional view is detailed of this alternate embodiment attached to the right hand glove for a left-handed golfer. Here as you can see, equal thickness pads 70, 72, and 74, are interposed between the golf shaft 21 and the index finger 71, middle finger 73, and ring finger 75 respectively. Again, little finger 77 has no pad attached to it, and all fingers are enclosed by glove 11. On the opposite side of golf club shaft 21, same thickness palm pad 76 resides between palm area 78 and the golfer's hand. Glove 11, as shown, also encompasses the golfer's palm area.

Figure 11:
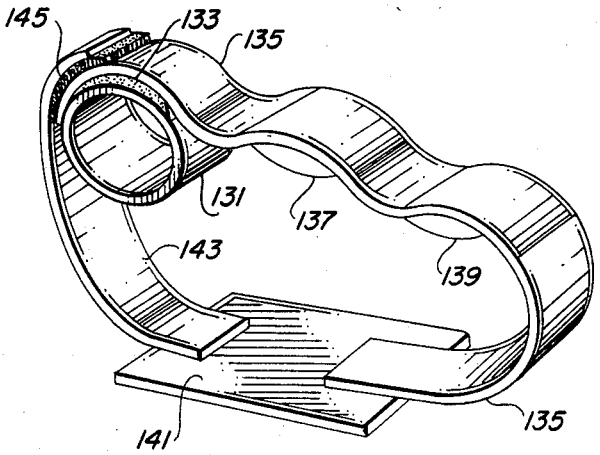
FIG. 11 is a perspective view of still another embodiment of the invention situated upon a flexible strap adapted to surround the golfer's hand.

FIG. 11 shows still another embodiment of the subject invention where the finger pads have been incorporated onto a single strap adapted to encircle the fingers as a group. Referring now to FIG. 11, lone finger sleeve 131 is adapted to reside on the golfer's index finger, either right or left hand as the case may be, having attached to it pad 133 which then in turn is covered by flexible strap 135. Strap 135 continues to the right where it picks up finger pad 137 adapted to be situated between the first and second joints of the middle finger as pad 133 was with respect to the index finger. Continuing to the right, strap 135 then has attached to it pad 139, also adapted to reside between the first and second joint of the ring finger. Strap 135 continues, passing the little finger and around to join flexible pad 141, pad 141 adapted to reside on top of all the fingers of the golfer's hand. A second short flexible strap 143 continues from flexible pad 141 which then joins the first strap 135 proximate the strap's connection with finger sleeve 131. As before, the finger pads 133, 137, and 139, as well as flexible pad 141, are attached to flexible strap 135 by sewing or an adhesive. Finger sleeve 131 similarly is held to finger pad 133 and strap 135 by sewing or an adhesive. For the connection of the flexible strap 143 to the end of flexible strap 135, a hook and latch type connection is suggested, such as by the application of Velcro material 145 and by such means, easy separation is accomplished.

It is noted that the alternate embodiment detailed in FIG. 11 may fit either upon the left hand or the right hand, whichever hand is the accuracy hand of the particular golfer. When changing from one hand to the other, the device only need be turned around so that the index finger enters the finger sleeve in the opposite direction.

While the Inventor has made a note of the fact that his invention is applied to the accuracy hand of the golfer or other player grasping the baseball bat, tennis racquet, or the like, experimentation has shown that the subject invention, in its various embodiments, may also be utilized by the player's power hand for those activities which require two hands, such as upon the club or bat, or the like. In those cases, it has been determined that utilization of the device on the party's power hand does lead to a firmer grip upon the club or other object.

While a preferred embodiment together with alternate embodiments have been shown and described, it will be understood that there is no intent to limit the invention by such disclosure, but rather it is intended to cover all modifications and alternate configurations falling within the spirit and the scope of the invention as defined in the appended claims.

I claim:

1. An improvement for attachment to a golfer's glove to enhance feel of the golf club in the hands of the golfer and thereby improve the golfer's swing, the improvement comprising:

a flexible first finger pad adapted to be situated between the first and second joints on the index finger;

a flexible second finger pad adapted to be situated between the first and second joints of the middle finger; and a flexible third finger pad adapted to be situated between the first and second joints of the ring finger, said finger pads operably attached to a golfer's accuracy hand glove in position where said finger pads are situated proximate the golfer's palm and between the first and second joints on the index, middle, and ring fingers respectively when the golfer wears the glove, each said finer pads having a differently determined thickness whereby the golfer, in grasping the golf club with his hand having the finger pads, has the feel of the golf club in his hand enhanced by increasing the pressure between the first three fingers and the golf club shaft, and thus better able to control the swing of the golf club for improved hitting.

2. The improvement to a golfer's glove as defined in claim 1 further including a palm pad operably attached to the golfer's accuracy hand glove, said palm pad so situated as to be located in the palm of the golfer's accuracy hand when he wears said glove, said palm pad having a thickness which is a function of the dimensions of the golfer's hand concavity and the distance between the palm and the golf club in the hand of the golfer as the golfer holds the golf club.

3. The improvement to a golfer's glove as defined in claim 1 wherein the thickness of each respective finger pad is a function of the distance between the finger and second joints of each respective finger receiving said finger pad and the resting position of the golf club in the hand of the golfer as the golfer holds the golf club.

4. The improvement to a golfer's glove as defined in claim 3 further including a fourth, fifth, and sixth finger pad operably attached to the golfer's power hand glove, said fourth, fifth, and sixth finger pads adapted to be situated between the first and second joints on the index, middle, and ring fingers of a golfer's power hand when he wears the glove.

5. The improvement to a golfer's glove as defined in claim 4 further including a palm pad operably attached to the golfer's power hand glove and so situated as to be located in the palm of the golfer's power hand when he wears the glove.

6. An improvement to be worn on a golfer's hand to enhance the feel of the golf club shaft in the hand of the golfer and thereby improve the golfer's swing, the improvement comprising:

a first finger pad adapted to be situated proximate the first and second joints of the index finger;

a second finger pad adapted to be situated proximate the first and second joints of the middle finger; and a third finger pad adapted to be situated proximate the first and second joints of the ring finger of a golfer's accuracy hand, said first, second, and third finger pads additionally adapted to be interposed the index, middle, and ring fingers respectively of the golfer's hand and the golf club shaft as it lies in the hand of the golfer, each said finger pad having a thickness determined by the distance between the first and second joints of each respective finger and the golf club resting in the hand of golfer as the golfer holds the golf club thereby enhancing the feel of the golf club in the golfer's hand by increasing the pressure between the first three fingers and the golf club shaft and thus making the golfer better able to control the swing of the golf club for improved hitting of the golf ball.

7. The improvement to be worn on a golfer's hand as defined in claim 6 further including holding means operably attached to said finger pads, said holding means adapted to secure said finger pads in place proximate the first and second joints of the index, middle, and ring fingers.

8. The improvement to be worn on a golfer's hand as defined in claim 7 wherein said holding means includes individual sleeves adapted to fit over the golfer's fingers between the first and second joints of the index, middle, and ring fingers respectively, each said sleeve having attached to it a respective finger pad.

9. The improvement to be worn on a golfer's hand as defined in claim 8 further including a plurality of straps, the first of said straps adapted to connect between the sleeve adapted to fit over the golfer's index finger and the sleeve adapted to fit over the golfer's middle finger;

and a second strap, said strap adapted to connect the sleeve fitting over the golfer's middle finger and the sleeve fitting over the golfer's ring finger.

10. The improvement to be worn on a golfer's hand as defined in claim 7 wherein said holding means includes a flexible strap, said flexible strap operably attached to said first, second, and third finger pads and adapted to surround all the fingers as a group in a closed loop.

11. The improvement to be worn on a golfer's hand as defined in claim 10 wherein said holding means includes a sleeve adapted to reside over the index finger between the first and second joints, said sleeve operably attached to said first finger pad and said flexible strap.

12. The improvement to be worn on a golfer's hand as defined in claim 11 further including a palm pad adapted to be positioned in the palm of the golfer's hand, said palm pad including an attached flexible strap adapted to surround the golfer's hand to hold the palm pad in place in the palm of the golfer'hand.

13. The improvement to be worn on a golfer's hand as defined in claim 12 wherein said respective finger pads have a thickness determined by the distance between the first and second joints of each respective finger and the golf club shaft resting in the hand of the golfer, and said palm pad has a thickness determined by the dimension of the concavity of the hand of the golfer.

14. The improvement to be worn on a golfer's hand as defined in claim 13 further including first, second, and third finger pads situated proximate the first and second joints of the index, middle, and ring fingers, and a palm pad adapted to be positioned in the palm of the golfer's hand, said finger pads and said palm pad adapted to be worn on the golfer's power hand.

15. An improvement to be worn on a sports player's accuracy hand to enhance the feel of a shaft in the player's hand that is swung in the game played by the player in order to improve the player's swing of the shaft, the improvement comprising:

a first finger pad adapted to be situated proximate the first and second joints of the index finer;

a second finger pad adapted to be situated proximate the first and second joints of the middle finger;

a third finger pad adapted to be situated proximate the first and second joints of the ring finger, said first, second, and third finger pads additionally adapted to be interposed the index, middle, and ring fingers respectively of the player's hand and the shaft as it lies in the hand of the player, each said finger pad having a thickness determined by the distance between the first and second joints of each respective finger and the shaft resting in the accuracy hand of player as the player holds the shaft; and a palm pad adapted to be situated in the palm of the player's accuracy hand, thereby enhancing the feel of the shaft in the player's hand by increasing the pressure between the first three fingers and the palm, and the shaft, and thus making the player better able to control the swing of the shaft for improved swinging.

* * * * *